US011852361B2

(12) United States Patent
Moro

(10) Patent No.: US 11,852,361 B2
(45) Date of Patent: Dec. 26, 2023

(54) SUPPORT MEMBER FOR AIR PIPES OF PORTABLE AIR CONDITIONERS

(71) Applicant: DE' LONGHI APPLIANCES S.R.L. CON UNICO SOCIO, Treviso (IT)

(72) Inventor: Andrea Moro, Treviso (IT)

(73) Assignee: DE' LONGHI APPLIANCES S.R.L. CON UNICO SOCIO, Treviso (IT)

( * ) Notice: Subject to any disclaimer, the term of this patent is extended or adjusted under 35 U.S.C. 154(b) by 546 days.

(21) Appl. No.: 16/875,939

(22) Filed: May 15, 2020

(65) Prior Publication Data

US 2021/0348775 A1 Nov. 11, 2021

(30) Foreign Application Priority Data

May 8, 2020 (IT) ..... 102020000010294

(51) Int. Cl.

| | |
|---|---|
| ***F24F 1/031*** | (2019.01) |
| ***F24F 1/0011*** | (2019.01) |
| ***F24F 1/04*** | (2011.01) |
| ***F24F 13/02*** | (2006.01) |

(52) U.S. Cl.

CPC ..... *F24F 1/031* (2019.02); *F24F 1/0011* (2013.01); *F24F 1/04* (2013.01); *F24F 13/0254* (2013.01)

(58) Field of Classification Search

CPC .. F24F 1/0011; F24F 1/031; F24F 1/04; F24F 13/0254

See application file for complete search history.

(56) References Cited

U.S. PATENT DOCUMENTS

| | | | | |
|---|---|---|---|---|
| 2012/0090344 | A1* | 4/2012 | Cho | F24F 13/18 62/262 |
| 2019/0212028 | A1* | 7/2019 | Zemborain | F24F 1/022 |
| 2020/0248911 | A1* | 8/2020 | Lei | F24F 13/32 |

FOREIGN PATENT DOCUMENTS

CN 109724171 A * 5/2019

OTHER PUBLICATIONS

Phoenix Contact, End cap—NS 35/7,5 CAP—1206560, Jun. 6, 2012, https://www.phoenixcontact.com/online/portal/us?uri=pxc-oc-itemdetail:pid=1206560&library=usen&tab=1 (Year: 2012).*

RepairClinic.com, GE Dishwasher Dish Rack Stop Clip Replacement #WD12X10304, Nov. 1, 2012, Youtube.com, Timestamp at 0:14, https://www.youtube.com/watch?v=T7ovJlmLol8 (Year: 2012).*

* cited by examiner

*Primary Examiner* — Elizabeth J Martin
(74) *Attorney, Agent, or Firm* — MARSHALL, GERSTEIN & BORUN LLP

(57) ABSTRACT

A support member for air-carrying pipes of portable air conditioners which can be applied to windows (W), comprises a first module provided with a slit made to accommodate the air pipe and at least one second module made to be coaxially sliding on the first module. The second module is continuously mobile with respect to said first module to make the length of the support member modifiable.

9 Claims, 4 Drawing Sheets

SUPPORT MEMBER FOR AIR PIPES OF PORTABLE AIR CONDITIONERS

FIELD OF THE INVENTION

Embodiments described here concern a support member, for air-carrying pipes of portable air conditioners, which can be applied to windows, in particular to window frames with mobile parts, with a sliding motion.

BACKGROUND OF THE INVENTION

It is known to use conditioners, in particular air conditioners, to condition the temperature of an internal space, such as a room.

Air conditioners can be distinguished between fixed and portable.

Portable air conditioners, compared to fixed air conditioners, have the advantage that they are independent from the systems of the building, they can be moved according to requirements from one space to another, they have a lower cost and do not require fixed installations.

As is well known portable air conditioners provide to use an air outlet pipe necessary to extract from the air conditioning system the hot air that is generated in the process of conditioning the air of the indoor space.

The air has to be taken outside of the space in which the portable air conditioner is being used; therefore the outlet pipe has to be put in communication with a second space, for example, with the external environment.

Typically, the hot air is taken outside by taking advantage of the presence of a window which generally is either left open so that is can accommodate the air outlet pipe, or has a hole of adequate size made in the glass to accommodate at least one end of the pipe.

One disadvantage is that, in the event that the window has to be kept open, there is constantly an unwanted exchange between the external and internal space which can allow dust, pollen, exhaust gases, insects, water etc. to enter, creating consequent inconveniences, among which promoting the heating of the air-conditioned space during the air-conditioning. or later.

This last disadvantage also entails a consequent energy waste, given that the temperature and humidity characteristics of the external air limit the air conditioning of the internal space.

Support members exist, which comprise a flat element, which can be positioned resting on an internal or external side of a window, and provided with a slit in which one end of the air pipe can be inserted. One disadvantage of these known support members is that they do not allow a stable anchoring in correspondence with the window, and therefore a safe positioning of the air pipe, which can move and be damaged in the event of an unwanted closing of the window, for example due to a gust of wind, or a draft of air, with consequent risk of damage to the pipe and inefficiency of the air conditioner.

There is therefore the need to perfect a support member for pipes of portable air conditioners which can be applied to windows, which can overcome at least one of the disadvantages of the state of the art.

In particular, one purpose of the present invention is to provide a support member for air-carrying pipes of portable air conditioners, which can be applied to windows to allow the air pipes to extend outside and at the same time isolate the internal space from the external environment.

Another purpose of the invention is to provide a support member which can be adapted to windows, in particular with sliding opening, of any size whatsoever.

Another purpose of the present invention is to provide a support member for air pipes which allows a stable and safe positioning of the air pipe.

The Applicant has studied, tested and embodied the present invention to overcome the shortcomings of the state of the art and to obtain these and other purposes and advantages.

SUMMARY OF THE INVENTION

The present invention is set forth and characterized in the independent claim. The dependent claims describe other characteristics of the present invention or variants to the main inventive idea.

In accordance with the above purposes a support member is provided for air outlet pipes of portable air conditioners which can be applied to windows, in particular to window frames provided with guide elements for mobile parts with sliding motion, which overcomes the limits of the state of the art and eliminates the defects present therein.

The invention can advantageously be applied on sash windows, also known as single hung, double hung, or on windows provided with guide elements for rolling shutters, or other similar ones.

In these types of windows the lifting or opening movement and the lowering or closing movement of the mobile parts occurs along the sliding guides with which the frame is provided and on which the mobile parts are free to slide directly, or by means of supports.

Normally the air pipe of the portable air conditioner is substantially positioned in the space between the mobile part and the frame, and possibly wedged between them, causing the disadvantages described above.

In accordance with the purposes above, the invention provides a support member provided with a slit to associate the air pipe, suitable to be inserted into the space between the frame and the mobile part of the window, guaranteeing a stable positioning thereof regardless of the position of the window, that is the panel with the pane of glass.

In this way it is possible to provide the dispersion of hot air generated by the portable air conditioner into the external environment preventing or at least limiting the communication of the latter with the internal space.

The support member according to the invention comprises a first module provided with a slit for positioning the air pipe, at least a second module sliding with respect to the first module, and clamping members configured to reciprocally clamp the first and the second module into a defined position.

According to one aspect of the invention, the first and the at least one second module are provided, in correspondence with their ends, with respective stabilizing members configured to be inserted in and cooperate with sliding guides provided on a frame of a window.

In this way the invention can be advantageously applied to an already existing structure without needing to carry out carpentry interventions on the window, which is inserted in the guides provided for a portion of the window to slide, or for the shutters to slide.

The stabilizing members can have a substantially flat terminal portion, or which has a constant thickness, much smaller than its planar extension.

This allows to obtain a stable positioning of the support member regardless of the position of the mobile part, which can therefore be moved without risk of making the support member and the pipe associated with it drop.

The support member is made so that it can adapt to window frames of any size whatsoever, in a simple manner and without resorting to other tools, or without having to make modifications to the window thanks to a continuous adjustment system.

The continuous adjustment of the length of the support member to the window frame is also extremely simple and does not requires any skills or the use of particular tools or utensils.

Thanks to the continuous adjustment it is not necessary to know the size of the window on which to apply the invention.

Advantageously, therefore, it is not necessary to have multiple support members if the portable air conditioner is used in spaces with windows of different sizes.

This also allows to overcome possible deformations of the window frame or modifications of its size, even of a few millimeters, which could prevent the insertion of other supports of a fixed length or with discrete length adjustment.

The present invention also concerns a method to install a support member for air pipes on a window, wherein the method provides to:

slidingly associate a first module and at least one second module;

move them by making them slide with respect to each other until respective stabilizing members provided on the first module and on the second module are inserted into respective guides of a frame of the window;

reciprocally clamp the first module and the second module into position.

BRIEF DESCRIPTION OF THE DRAWINGS

These and other aspects, characteristics and advantages of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We will now refer in detail to the possible embodiments of the invention, of which one or more examples are shown in the attached drawings. Each example is supplied by way of illustration of the invention and must be understood as a non-limiting example just as the phraseology and terminology used here are for non-limiting descriptive purposes only.

Figure 13:
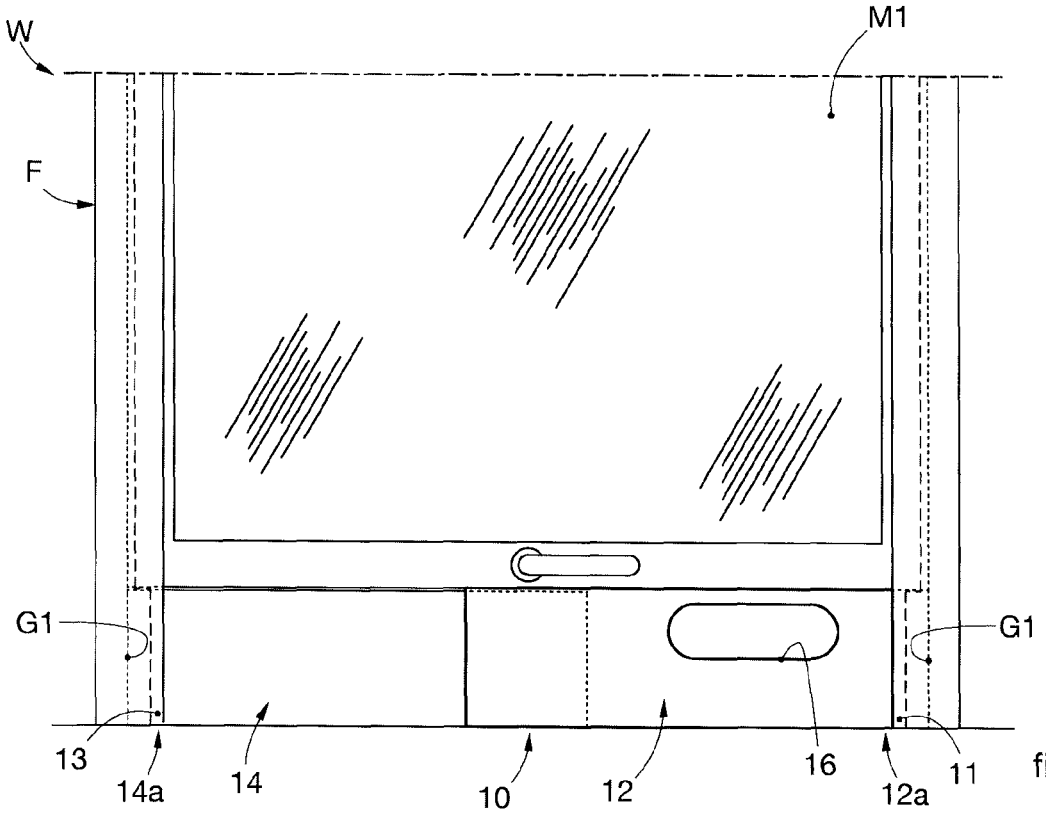
FIGS. 13 and 14 are schematic representations of a support member in accordance with embodiments described here applied to a window.
Figure 14:
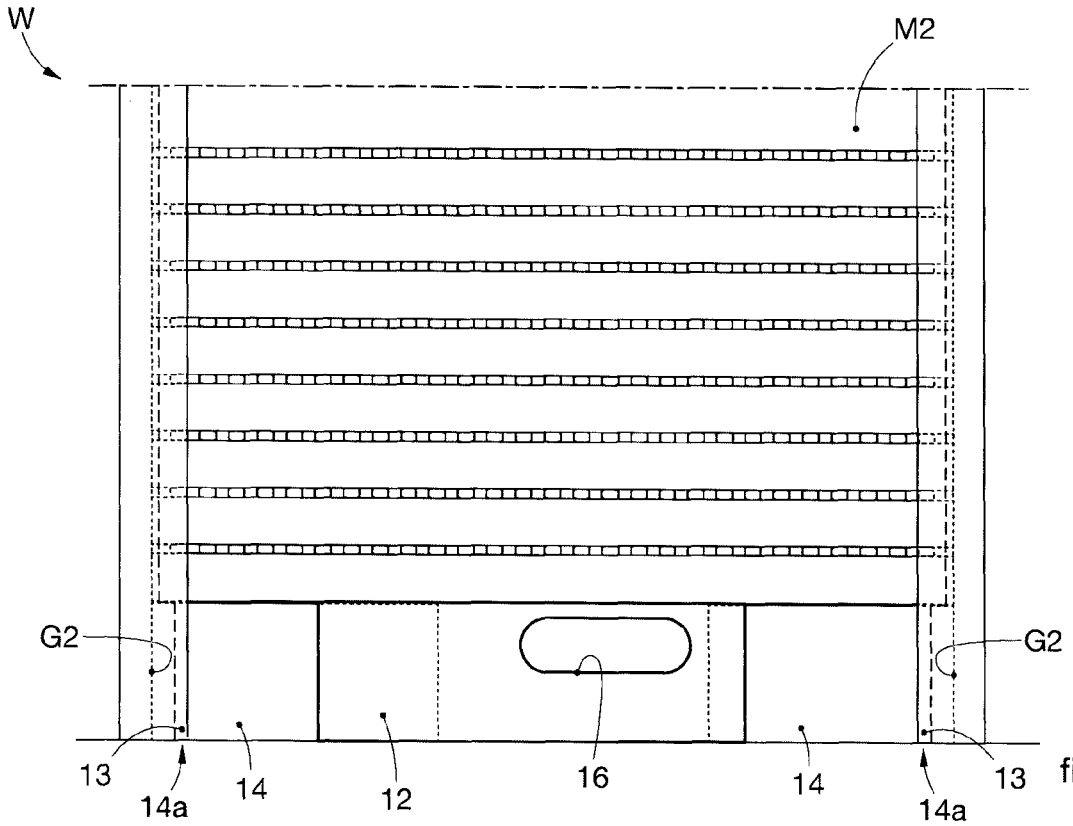

Embodiments described here concern a support member for air pipes of portable air conditioners, indicated as a whole with reference number 10 in the attached drawings. The support member 10 can in particular be applied to windows W, in particular to window frames F provided with sliding guides G1, G2 for mobile parts M1, M2, (FIGS. 13 and 14).

The invention can advantageously be applied on windows W such as sash windows, or vertical sliding windows, also known as single hung, or double hung, horizontal sliding windows, or windows equipped with rolling shutters or other similar covering devices.

With particular reference to FIGS. 1, 2, 4 and 9, the support member 10 comprises at least one first module 12 provided with a slit 16 made to accommodate one end of the air pipe.

The support member 10, also, comprises at least one second module 14, which is made to be axially sliding with respect to the first module 12.

According to one aspect of the invention the second module 14 is continuously mobile with respect to the first module 12 to make the length of the support member 10 modifiable as desired so that it can adapt to the frame F of any window W whatsoever.

According to some embodiments, the first 12 and the at least one second module 14 are provided, in correspondence with their ends, with respective first stabilizing members 11 and second stabilizing members 13 suitable to cooperate with sliding guides G1, G2 provided on a frame F of a window W.

In this way, the invention can be advantageously applied on an already existing structure without needing to carry out carpentry interventions on the window W, which is inserted into the guides G1 provided for the sliding of a portion of window M1, or for the sliding of the rolling shutters M2.

The stabilizing members 11, 13 can have a substantially flat terminal portion, that is having a constant thickness, much smaller than its planar extension.

The thickness of the first 11 and second stabilizing members 13 can be comprised between 1.5 and 4 mm, making the support member 10 suitable to be inserted and clamped in most sliding guides G1, G2 for portions of windows M1 or rolling shutters M2, reducing to a minimum the play between the support member 10 and the frame F of the window W.

This guarantees a stable positioning of the support member 10 and therefore of the air pipe, and at the same time allows the closure of the portion of window M1 or of the rolling shutter M2 substantially until there is contact with an edge of the support member 10.

Figure 2:
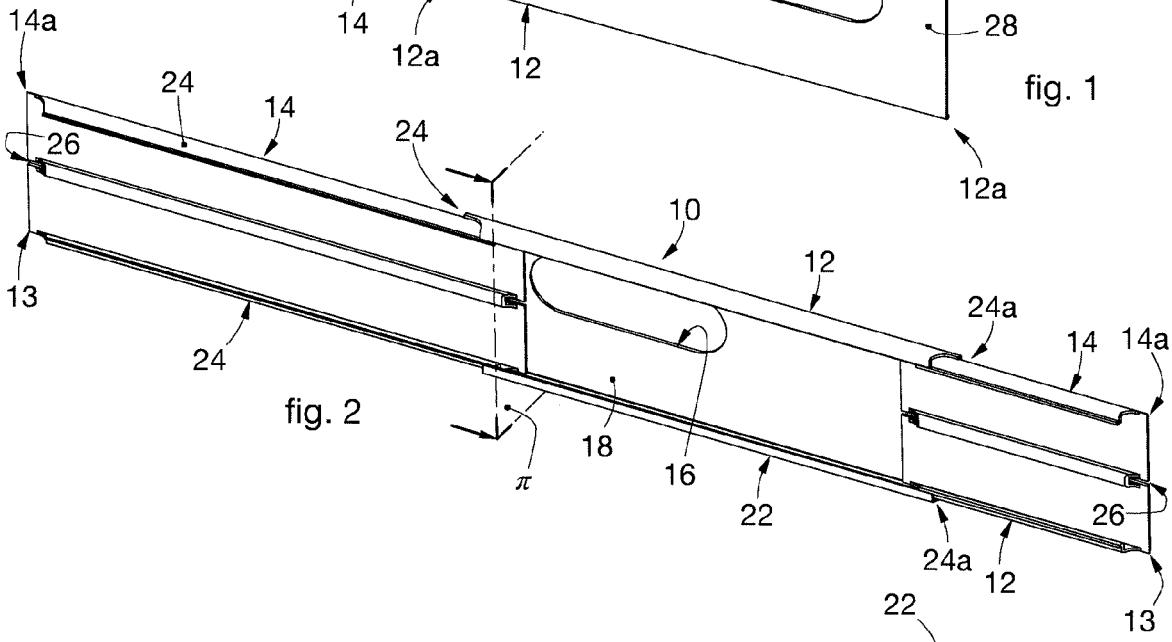
FIG. 2 is a rear perspective view of the invention in accordance with embodiments described here.
Figure 2A:
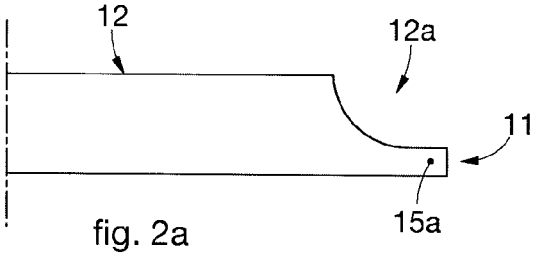
FIGS. 2*a* and 2*b* are a detail of FIG. 1.
Figure 2B:
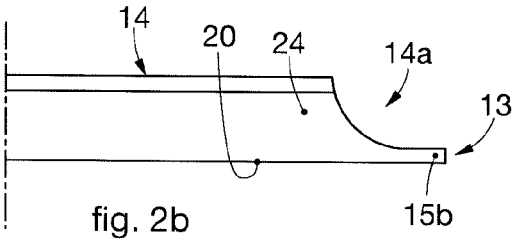
Figures 9, 10, 11, 12:
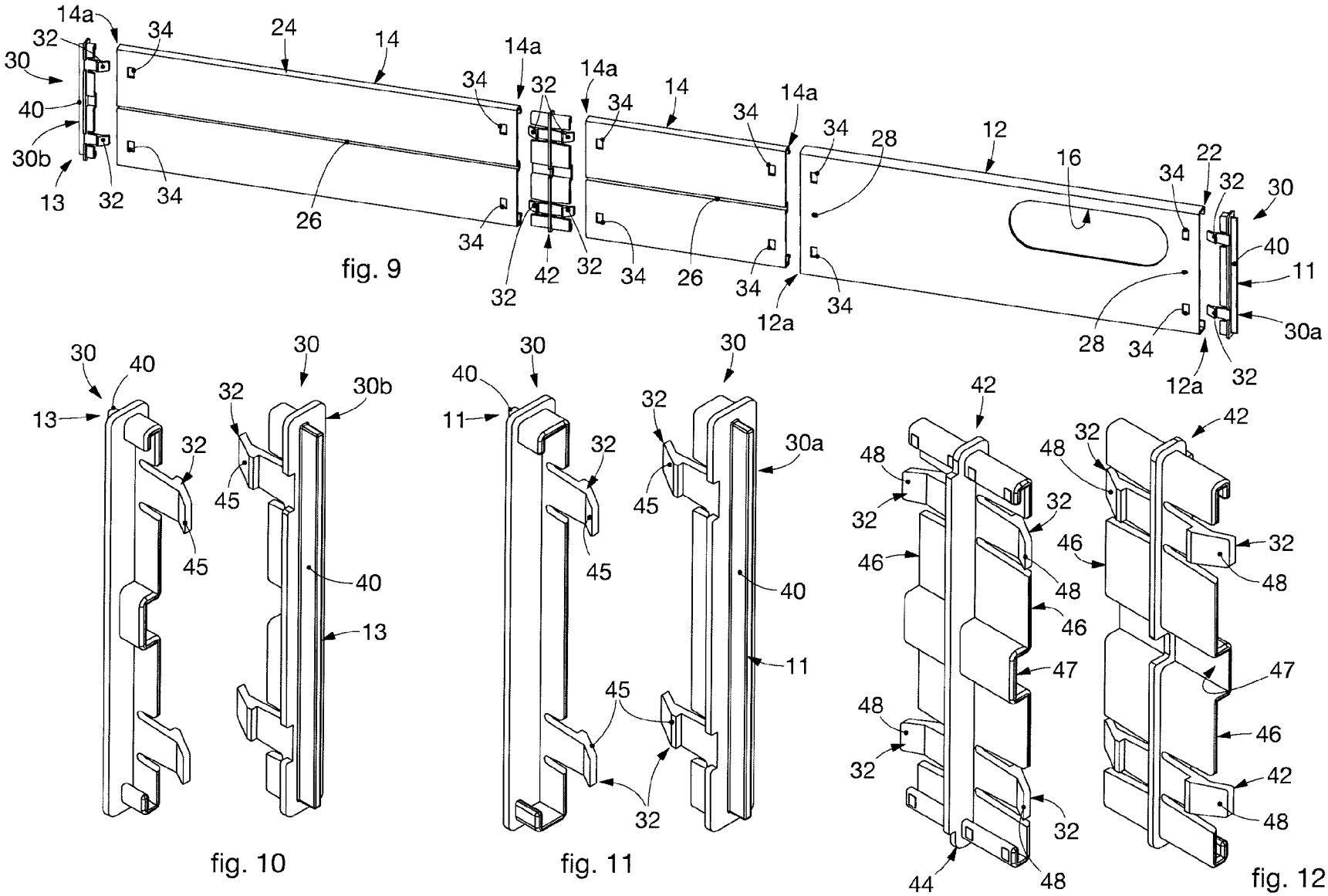
FIG. 9 is a front perspective view of the invention in accordance with other embodiments described here.
FIGS. 10 and 11 are front and rear perspective views of adapter elements in accordance with embodiments described here.
FIG. 12 are front and rear perspective views of an embodiment of continuity elements in accordance with embodiments described here.

According to possible variants, the support member 10 can provide to use two second modules 14 in order to increase the development in length of the support member 10, where required by the sizes of the frame F of the window W on which it has to be applied (FIGS. 2 and 9).

According to some embodiments, the first module 12 and the, or each, second module 14, each have respective two ends 12*a*, 14*a*, between which respective first sliding means 22 and second sliding means 24 develop, at least partly (FIG. 2).

In accordance with some embodiments, the first sliding means 22 and the second sliding means 24 can be a pair of opposite guides or sliders and are made to provide the smooth and continuous sliding of the first 12 and the second module 14 one on the other.

According to some embodiments, the first module 12 and the second module 14 can each have a substantially flat larger wall, which, during use, are disposed parallel to each other.

The first 22 and the second sliding means 24 can be disposed on respective opposite long sides of the respective flat wall.

Figure 3:
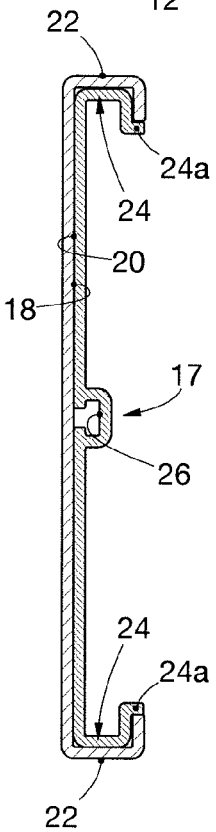
FIG. 3 is a section view along the plane π of FIG. 2.

With reference to FIG. 3, the first sliding means 22 and the second sliding means 24 are guides which can be associated with each other thanks to the complementarity of their shape.

According to one variant, the first sliding means 22 and the second sliding means 24 can have a substantially U-shaped profile, mating in shape.

In particular the second sliding means 24 can be configured to be inserted into and slide inside the first sliding means 22.

According to another variant, the U-shaped profile of the second sliding means 24 can have one end 24*a* which extends in an orthogonal direction with respect to the arm of the "U", and acts as a contrast edge for the first sliding means 22.

Figure 1:
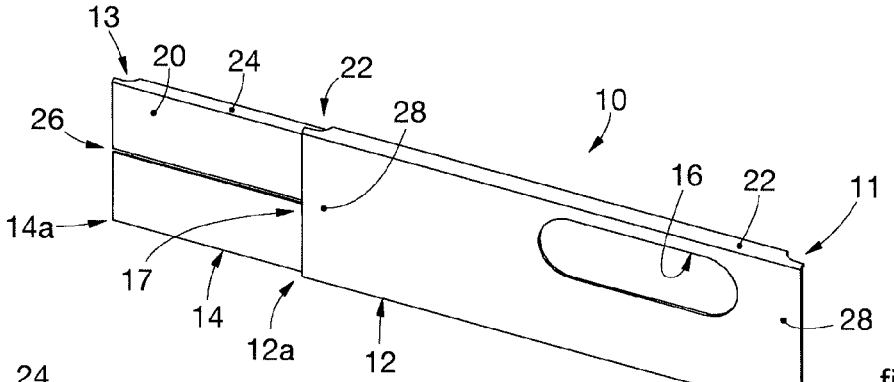
FIG. 1 is a front perspective view of the invention in accordance with embodiments described here.

During use, the first sliding means 22 and the second sliding means 24, provide to take a first sliding surface 18 of the first module 12 to face a second sliding surface 20 of the second module 14 (FIGS. 1 and 2).

Therefore, during use, the second module 14 can be made to slide between the sliding means 22 of the first module 12 in order to make it adaptable to the frame F of the window W in which the support member 10 has to be applied.

According to some embodiments, the support member 10 comprises clamping means 17 suitable to reciprocally clamp the first module 12 and the second module 14 in any position whatsoever.

According to some embodiments, the first sliding surface 18 is provided with at least one hole 28 and the second sliding surface 20 is provided with a groove 26, or channel. The at least one hole 28 cooperates, during use, with the groove 26 to allow known attachment means (not shown) to stabilize the position of the second module 14 with respect to the first module 12.

The groove 26 can have a closed rear portion, with a larger size, suitable to house the head of a screw or suchlike.

This allows the second module 14 to be clamped in any position whatsoever along the development of the groove 26 to make it integral with the first module 12.

According to some embodiments, the ends 12*a*, 14*a* of the first 12 and the second module 14 can be tapered, in order to be associated with or inserted inside the sliding guides G1, G2 of the frame F on which the mobile parts M1, M2 of the window F move (FIGS. 2*a* and 2*b*, 13-14).

In particular the first 22 and the second sliding means 24 can have a thickness which is gradually reduced in the proximity of the respective terminal portions 12*a*, 12*b*, until they disappear in correspondence with the respective terminal portions 12*a*, 12*b*.

The tapered ends 12*a*, 14*a* can have a substantially flat terminal portion 15*a*, 15*b*, that is having a constant thickness, much smaller than its planar extension.

The end portions 15*a*, 15*b* can have a thickness substantially corresponding to the thickness of the flat wall of the respective support member 12, 14, or possibly slightly larger.

In this case the ends 12*a*, 14*a* themselves define the stabilizing members 11, 13.

Figure 4:
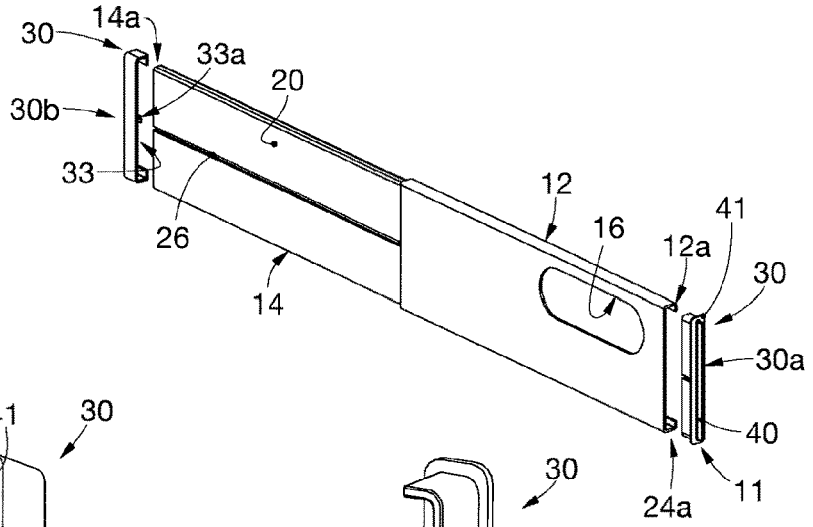
FIG. 4 is a front perspective view of the invention in accordance with other embodiments described here.

In other embodiments, the support member 10 can comprise adapter elements 30, each of which can be associated with a respective end 12*a*, 14*a*, of the first 12 or of the second module 14, which are suitable to allow the association of the at least one first module 12 and of the second module 14 with the sliding guides G1, G2 (FIGS. 4 and 9).

In this case the first 11 and the second stabilizing members 13 are provided on respective adapter elements 30.

The adapter elements 30 can be applied both if the ends 12*a* and 14*a* are tapered or, also to ends 12*a* and 14*a* that have not been worked, as visible in FIGS. 4 and 9.

In the case of tapered ends 12*a*, 14*a*, it can be provided that the adapter elements 30 are provided, in a position opposite the stabilization members 11, 13, with one or more pairs of protruding gripper elements, at least partly elastic, suitable to deform in order to receive and retain between them a portion of the flat wall of the respective support member 12, 14.

This makes it possible to renovate and adapt already existing support members 10, making them suitable to cooperate with the guides G1, G2 of the windows W.

The support member 10 can, therefore, be provided with the at least one first module 12 or with the second module 14 without particular workings since it will be the adapter elements 30 that provide the stabilization members 11, 13 for the association with the frame of the window.

The adapter elements 30 have a body 38 from which a flap 40 protrudes, defining a respective stabilizing member 11, 13, having a shape substantially complementary to the sliding guide G1, G2 of the frame for which it was made.

This solution makes producing the modules 12, 14 more convenient and simple since they do not need working to be tapered and, moreover, makes them adaptable to any window frame whatsoever thanks to the interchangeable adapter elements 30, allowing to associate on each occasion the one that is compatible with the guide in which the support member 10 is applied.

In accordance with some embodiments, the adapter elements 30 can be associated with the ends 12*a*, 14*a* of the first module 12 and of the at least one second module 14 thanks to the complementarity of their shape.

The adapter elements 30 can comprise first adapter elements 30*a* suitable to be associated with the first module 12 and second adapter elements 30*b* suitable to be associated with the second module 14.

According to some embodiments, the first 30*a* and the second adapter elements 30*b* can be configured to couple respectively with the first 22 and with the second sliding means 24.

The first 30*a* and second adapter elements 30*b* can be the same or different from each other, but in any case they have a fin 40 of constant thickness, defining a stabilizing mean 11, 13.

In particular, according to a possible solution, the first adapter elements 30*a* can be made so that they are associated internally with the first module 12 and the second adapter elements 30*b* can be made so that they associate externally with the second module 14.

Figure 5:
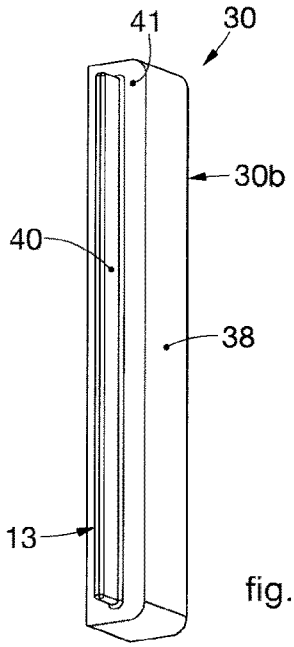
FIG. 5 is a front perspective view of a first adapter element of FIG. 4.
Figure 6:
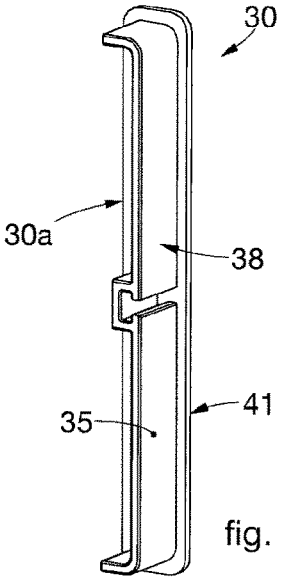
FIG. 6 is a rear perspective view of a second adapter element of FIG. 4.

Another view of the adapter elements 30*a* and 30*b* of FIG. 4 is visible, respectively, in FIG. 5 and FIG. 6.

The body 38 of the second adapter element 30*b* has a concave seating 33 suitable to receive one end 14*a* of a second module 14. The seating 33 can, also, comprise a shaped portion 33*a* with a shape mating with the groove 26 and suitable to cooperate with it in order to guarantee a stable coupling.

The body 38 of the first adapter element 30*a* can have a shaped portion 35 having a shape mating with that of a second module 14, and suitable to be inserted between the sliding means 22.

Figure 7:
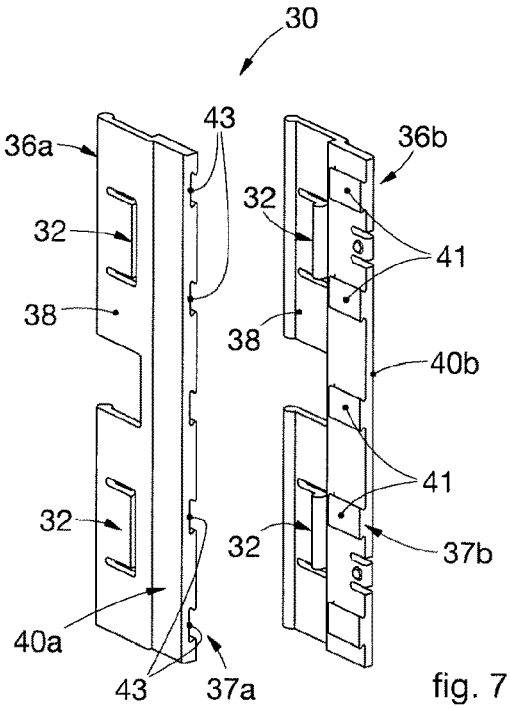
FIG. 7 is a perspective view of one variant of an adapter element in accordance with embodiments described here.
Figure 8:
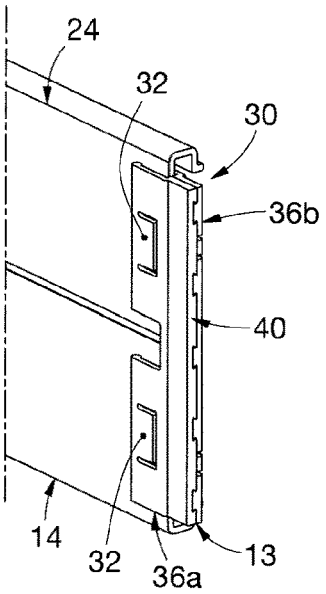
FIG. 8 is a front perspective view of the adapter element of FIG. 7 during use in accordance with embodiments described here.

FIGS. 7 and 8 are used to describe one variant embodiment of the adapter elements 30, each of which consists of a pair of half-elements 36*a*, 36*b* which can be assembled during use, to each clamp opposite surfaces on the two sides of the at least one first module 12 and of the second module 14 as can be seen in FIGS. 7 and 8.

The half-elements 36*a*, 36*b* are provided with respective coupling members 37*a*, 37*b* configured to produce a stable coupling between them.

According to some embodiments, the coupling members 37*a*, 37*b* can comprise respective protruding elements 41 and recesses 43 suitable to cooperate with respective elements with mating shape and position.

The coupling members 37*a*, 37*b* can also comprise attachment elements 32.

In this case each half-element 36*a*, 36*b* can have a portion 40*a*, 40*b* which, in assembled form, defines a flap 40.

According to these embodiments, the first module 12 and the second module 14 can be provided with through slots 34, made to associate with the respective attachment means 32 possibly provided in the adapter elements 30 (FIG. 9).

Another embodiment of the adapter elements 30*a* and 30*b* provided with attachment means 32 can be seen respectively in FIGS. 10 and 11.

According to these embodiments, the adapter elements 30*a*, 30*b* can both be configured to be inserted inside the respective sliding members 22, 24.

The attachment means 32 in this case can comprise one or more elastic tabs 48, inclined with respect to a longitudinal axis, suitable to be inserted and wedged into a respective slot 34.

According to possible variants, for example described with reference to FIG. 9, the support member 10 can comprise two second modules 14, which can be connected to each other so as to further increase the length of the support member 10, allowing a greater versatility and adaptation to a plurality of windows of different sizes and types.

For example, this configuration can be useful if the window is of the horizontal sliding type, or has a width greater than 120 cm.

According to these embodiments, there can be provided a continuity element 42 provided with attachment means 32 suitable to engage the slots 34.

With reference to FIG. 12, the continuity element 42 has a central section 44 from which the association elements 46 project in an opposite direction and in a substantially symmetrical manner.

In accordance with some embodiments, the association elements 46 can be a shaped profile to be associated thanks to the complementarity of shape with the end 14*a* of the second module 14, and to cooperate with the respective sliding members 24.

The association elements 46 can comprise a respective housing seating 47 suitable to receive the portion comprising the groove 26.

Also in this case, the attachment elements 32 can comprise one or more elastic tabs 47 inclined with respect to a longitudinal axis.

In order to clarify the application of the invention, please see FIGS. 13 and 14 in which the support member 10 is associated by way of example, to the frame of a single-double hung window W and to the frame of a window W provided with rolling shutters M2.

In both the example drawings, the window W is provided with a frame F in which a respective pair of guides G1 and G2 are made, in which a mobile part in the form of a portion of window M! or in the form of a rolling shutter M2 is partly inserted inside the latter in order to slide inside them.

The invention, thanks to the modular solutions it is provided with, can be adapted to the small frames of a single-double hung window up to the large frames that house the rolling shutters occupying the entire length of the frame F comprised between the two guides G1 and G2.

The support member 10 is inserted by its ends into the guides G1 and G2 providing a stable association with the frame F.

In FIG. 13, the support member 10 comprises a first module 12 and a second module 14, while in FIG. 14, the support member 10 comprises a first module 12 and two second modules 14.

Although the invention has been applied as an example to windows W with vertical guides G1, G2, the use on windows with horizontal guides is also contemplated.

The present invention also concerns a method to install a support member for air-carrying pipes on a window W, wherein the method provides to:

slidingly associate a first module 12 and at least one second module 14 by means of respective sliding means 22, 24;

move them with respect to each other until respective stabilizing members 11, 13 provided on the first module 12 and on the second module 14 are inserted into respective guides G1, G2 of a frame F of the window W;

reciprocally clamp the first module 12 and the second module 14 into position by means of clamping members 17.

It is clear that modifications and/or additions of parts may be made to the support member 10 and to the corresponding installation method as described heretofore, without departing from the field of the present invention as defined by the claims.

In the following claims, the sole purpose of the references in brackets is to facilitate reading and they must not be considered as restrictive factors with regard to the field of protection claimed in the specific claims.

The invention claimed is:

1. A support member for air-carrying pipes of portable air conditioners which can be applied to a frame of a window having sliding guides, the support member comprising: a first module provided with a slit, the slit arranged to accommodate at least one of the air-carrying pipes, and at least one second module arranged to be coaxially and continuously slidable relative to said first module to make the length of said support member modifiable, including at least one hole provided on a first sliding surface of the first module and a groove provided on a second sliding surface of the at least one second module, the groove and the hole configured to receive, during use, a screw fastener to clamp the position of said at least one second module with respect to said first module, and wherein each of said first module and said at least one second module includes at least one tapered end having a flat terminal portion, each tapered end and each flat terminal portion arranged to be inserted in and cooperate with the sliding guides provided on the window frame.

2. The support member for air-carrying pipes as in claim 1, wherein said first module and said at least one second module each have a shaped profile in cross-section, the shaped profile of the first module arranged to mate with the shaped profile of the at least one second module, and wherein during use, a first sliding surface of said first module faces a second sliding surface of said at least one second module.

3. The support member for air-carrying pipes as in claim 1, wherein stabilizing members are formed at least in part by the tapered ends and the flat terminal portions, and are integrated in said first module and in said at least one second module, and wherein the respective ends have a constant thickness.

4. The support member for air-carrying pipes as in claim 1, comprising adapter elements, each of which can be associated with a respective end, of the first module or of the at least one second module, and comprising a body configured to couple with a respective module, and wherein the adapter elements include a stabilizing fin protruding from said body.

5. The support member for air-carrying pipes as in claim 4, wherein a first one of the adapter elements is associated with the first module and is shaped to mate with the respective end of the first module, and wherein a second one of the adapter elements is associated with the at least one second module and is shaped to mate with the respective end of the at least one second module.

6. The support member for air-carrying pipes as in claim 4, wherein said first module and said at least one second module are provided with through slots configured to be associated with respective elastic tabs provided in said adapter elements.

7. The support member for air-carrying pipes as in claim 1, and further including adapter elements for joining an end of the first module to an end of the second module, and wherein said adapter elements include a first portion and a second portion joinable to one another using a coupling member disposed in a recess and an elastic tab sized to engage a slot in an adjacent end of either the first module or the at least one second module to secure respective ends of the first module and the at least one second module together.

8. The support member for air-carrying pipes as in claim 1, wherein said at least one second module can be associated with another second module by a continuity element disposed between the at least one second module and the another second module, the at least one second module and the another second module each having slots disposed adjacent terminal portions thereof, the continuity element including opposed pairs of elastic tabs arranged to engage corresponding slots to secure the at least one second module and the another second module together.

9. A method to install a support member for air pipes on a window, wherein the method comprises:

slidingly associating a first module and at least one second module;

moving the modules by making the modules slide with respect to each other until respective tapered ends having flat terminal portions provided on the first module and on the second module are inserted into respective guides of a frame of the window;

clamping the first module and the at least one second module into position using at least one hole provided on a first sliding surface of the first module and a groove provided on a second sliding surface of the at least one second module, the groove and the hole configured to receive, during use, a screw to clamp the position of said at least one second module with respect to said first module.

* * * * *